US007745709B2

(12) United States Patent
Benjamin

(10) Patent No.: US 7,745,709 B2
(45) Date of Patent: Jun. 29, 2010

(54) TREMOLO ATTACHMENT FOR A STRINGED INSTRUMENT

(76) Inventor: Mark L. Benjamin, 5110 US 12 West, Buchanan, MI (US) 49107

( * ) Notice: Subject to any disclaimer, the term of this patent is extended or adjusted under 35 U.S.C. 154(b) by 0 days.

(21) Appl. No.: 12/288,798

(22) Filed: Oct. 23, 2008

(65) Prior Publication Data

US 2010/0101398 A1 Apr. 29, 2010

(51) Int. Cl.
*G10D 3/00* (2006.01)

(52) U.S. Cl. ..... 84/313

(58) Field of Classification Search ..... 84/312 R, 84/313

See application file for complete search history.

(56) References Cited

U.S. PATENT DOCUMENTS 2,741,146 A 4/1956 Fender
5,886,270 A * 3/1999 Wynn ..... 84/313
6,137,039 A * 10/2000 Rose ..... 84/298

* cited by examiner

*Primary Examiner*—Kimberly R Lockett
(74) *Attorney, Agent, or Firm*—R. Tracy Crump

(57) ABSTRACT

This tremolo device includes a flat hand plate and a short mounting post welded perpendicularly to bottom of the hand plate. The hand plate is configured and bent to form a curved eminence and depression along one side, which provides additional structural integrity and rigidity to the tremolo device. The mounting post is adapted to rotatably connect to the bridge assembly of a stringed instrument. The mounting post elevates the hand plate over the bridge assembly and instrument strings. The musician can rest the palm of the picking hand on the top of the hand plate, which positions the fingers conveniently over the instrument's strings. The musician can push or pull on the hand plate to apply force to the bridge and change the tension of instrument's strings.

2 Claims, 9 Drawing Sheets

TREMOLO ATTACHMENT FOR A STRINGED INSTRUMENT

This invention relates to a tremolo device for stringed musical instruments, and in particular a tremolo device or attachment for a guitar.

BACKGROUND AND SUMMARY OF THE INVENTION

A tremolo arm or tremolo bar (also called a "whammy bar" or "wang bar") is a lever attached to the bridge and/or the tailpiece of an electric guitar or archtop guitar to enable the player to quickly vary the tension and sometimes the length of the strings temporarily, changing the pitch to create a vibrato, portamento or pitch bend effect. The tremolo arm acts as a lever that the player can push or pull to change the strings tension. Typically, conventional tremolo arms are formed from a length of metal rod, which is bent to the desired shape. Tremolo bars are mount to the guitar's bridge assembly to rotate toward and away from the instrument strings.

Conventional tremolo bars have several drawbacks. During performance, the tremolo bars hang from the bridge swung away from the strings until the musician physically swings the bar upward into position close to the strings where it can be pulled or pushed to create the desired effect. Having to reach for the hanging tremolo bar to swing it into position for use is inconvenient for the musician. In addition, the metal rod of conventional tremolo bars flexes during aggressive performance, which result is less control of the sound of the instrument.

The tremolo device embodying the present invention transfers more force to the bridge for greater sound control and is always available to the musician without interfering with the playing of the instrument. The tremolo device of this invention includes a flat hand plate and a short mounting post welded perpendicularly to bottom of the hand plate. The hand plate is configured and bent to form a curved eminence and depression along one side, which provides additional structural integrity and rigidity to the tremolo device. The mounting post is adapted to rotatably connect to the bridge assembly of a stringed instrument. The mounting post elevates the hand plate over the bridge assembly and instrument strings. The musician can rest the palm of the picking hand on the top of the hand plate, which positions the fingers conveniently over the instrument's strings. The musician can push or pull on the hand plate to apply force to the bridge and change the tension of instrument's strings.

The tremolo device of this invention eliminates the problem of tremolo bars hanging out of the reach of the musician's picking hand. The tremolo device is always readily accessible from the pick hand's natural playing posture. While always readily available to the musician, this tremolo device is located where it does not interfere with the normal playing of the instrument. Moreover, the tremolo device offers the musician a better playing posture by allowing the pick hand to rest atop the hand plate. The tremolo device of this invention is also more rigid than a conventional tremolo bar, which affords the musician greater control over the sound of the instrument. Because the mounting post is relatively short and securely welded to the hand plate, the musician can transfer more force through this tremolo device to the tremolo bridge.

These and other advantages of the present invention will become apparent from the following description of an embodiment of the invention with reference to the accompanying drawings.

BRIEF DESCRIPTION OF THE DRAWINGS

The drawings illustrate an embodiment of the present invention, in which.

DESCRIPTION OF THE PREFERRED EMBODIMENT

Figure 1:
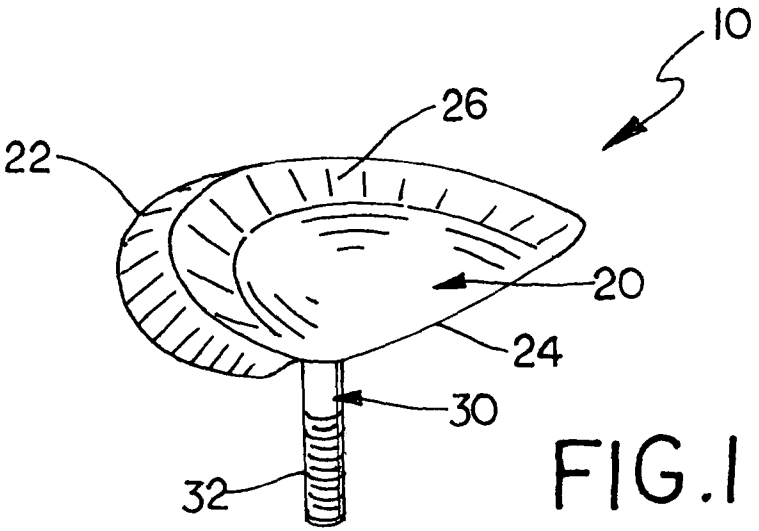
FIG. 1 is a perspective view of an embodiment of the tremolo device of this invention.
Figure 3:
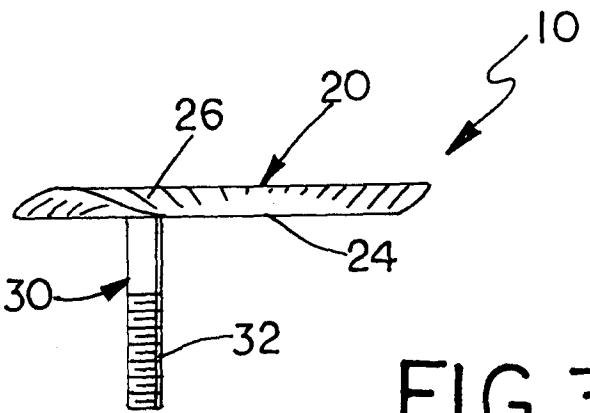
FIG. 3 is a front side view of the tremolo device of FIG. 1.
Figure 2:
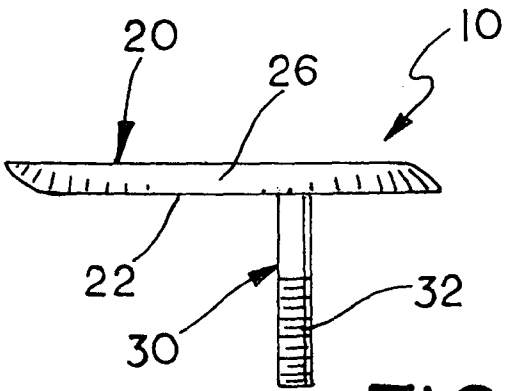
FIG. 2 is a back side view of the tremolo device of FIG. 1.
Figure 5:
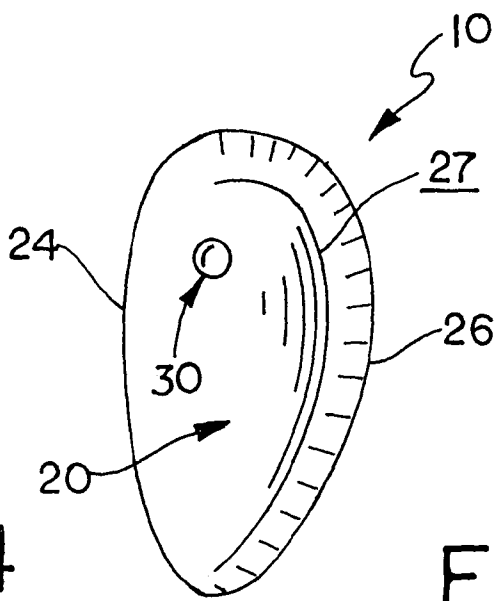
FIG. 5 is a bottom view of the tremolo device of FIG. 1.
Figure 4:
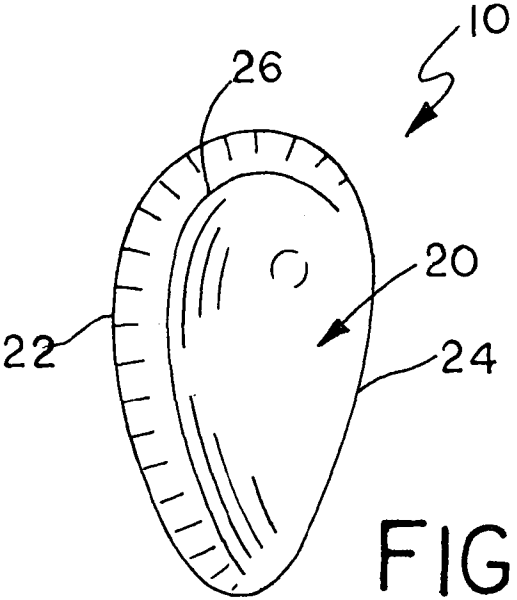
FIG. 4 is a top view of the tremolo device of FIG. 1.
Figure 7:
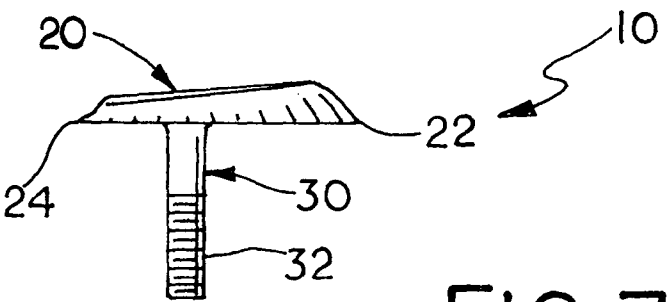
FIG. 7 is another end view of the tremolo device of FIG. 1.
Figure 6:
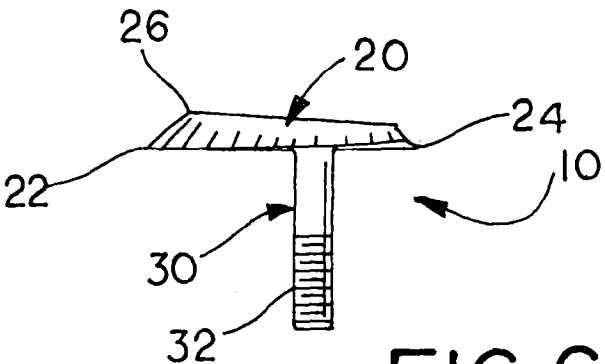
FIG. 6 is an end view of the tremolo device of FIG. 1.

Referring now to the drawings, reference numeral 10 generally designates an embodiment of the tremolo device of this invention. Tremolo device 10 allows a musician to vary the tension the instrument's strings and create a vibrato, portamento or pitch bend effect. Tremolo device 10 includes a relatively flat hand plate 20 and a mounting post 30. Generally, hand plate 20 is stamped from sturdy sheet metal, and mounting post 30 is constructed from metal bar stock welded to hand plate 20; however, hand plate 20 and post 30 can be integrated and constructed from a suitably sturdy polymer or other suitable material. As shown, hand plate 20 has an egg-shaped or ovate configuration with one side 22 slightly more prominently curved than the opposite side 24. Hand plate 20 is relatively flat, but is bent or formed to have an elongated arcuate eminence 26 formed in its top face extending along the peripheral edge of the more prominently curved side 22 approximately half the circumference of the plate and a corresponding elongated depression 27 formed on its bottom face. Eminence 26 and depression 27 formed in hand plate 30 provides additional structural rigidity to hand plate 20, which prevents it from flexing when used by a musician. Post 30 extends from the bottom of hand plate 20 and is off set from the center of hand plate 20 and toward one end thereof. As shown, the end 32 of post 30 is threaded to allow the post to be turned into a threaded bore 7 of a tremolo bridge 4. Alternatively, the end of post 30 can be adapted for mounting to any type of tremolo bridge within the teachings of this invention. One skilled in the art will note that different brands and models of tremolo bridges, as well as different instruments, use differing means for connecting a tremolo device to the bridge plate and post 30 can be readily modified to accommodate any such connection means.

Figure 9:
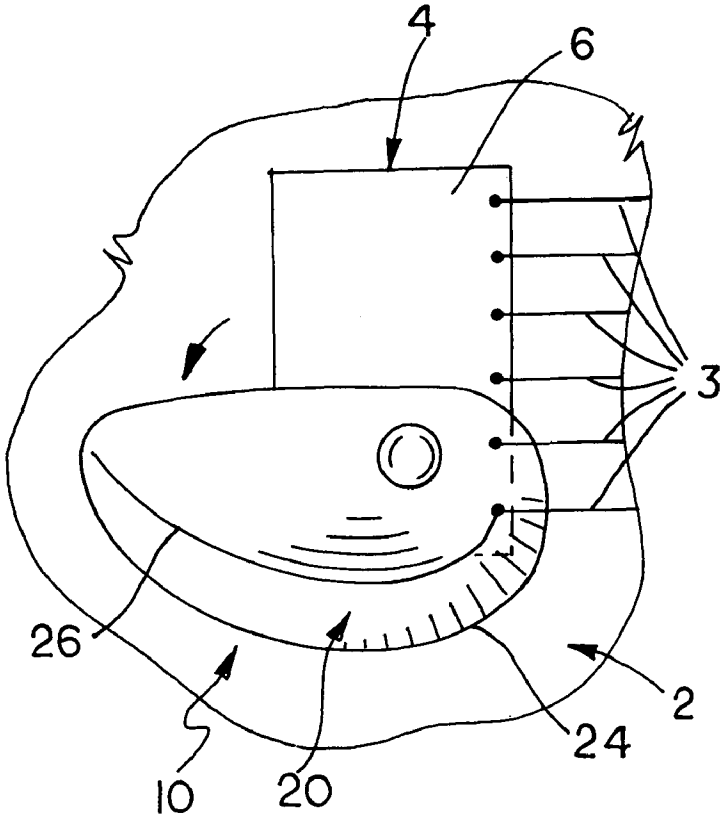
FIG. 9 is a partial top view of the tremolo device mounted to a guitar and oriented in a longitudinal position relative to the instrument strings.
Figure 8:
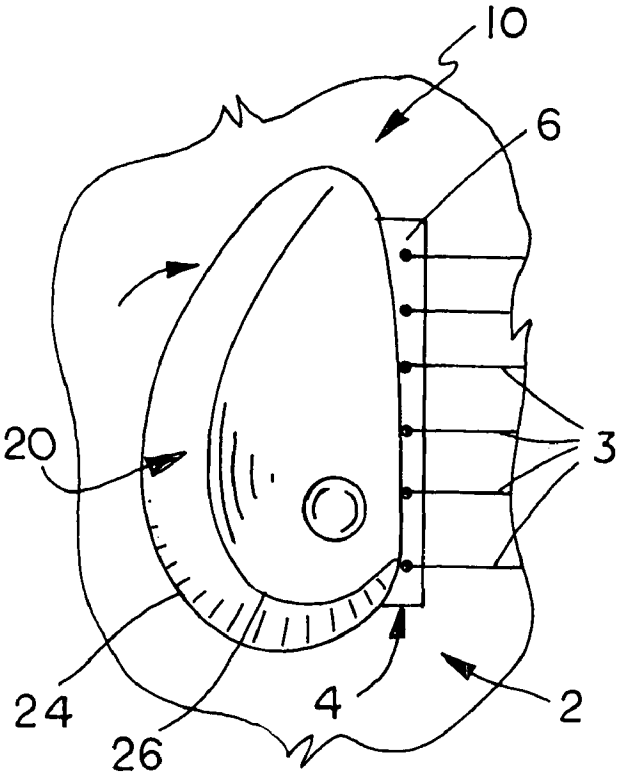
FIG. 8 is a partial top view of the tremolo device mounted to a guitar and oriented in a lateral position relative to the instrument strings.

FIGS. 8 and 9 show tremolo device 10 mounted to a simplified tremolo bridge assembly 4 of a conventional guitar 2. Tremolo device 10 is mounted to bridge assembly 4 by simply turning the threaded end 32 of mounting post 30 into a threaded bore in bridge plate 6. Post 30 is turned into the bore a sufficient number of turns to provide a secure connection, while allowing tremolo device 10 to rotate freely. While the drawings illustrate the tremolo device 10 used on a guitar, the teaching of this invention can be readily adapted for use with any stringed instrument and tremolo bridge assembly within the teachings of this invention. As shown, post 30 elevates plate 20 over bridge 4 and strings 3 and allows tremolo device 10 to swing between a lateral orientation relative to the strings (FIG. 8) and a longitudinal orientation relative to the strings (FIG. 9).

Figure 10:
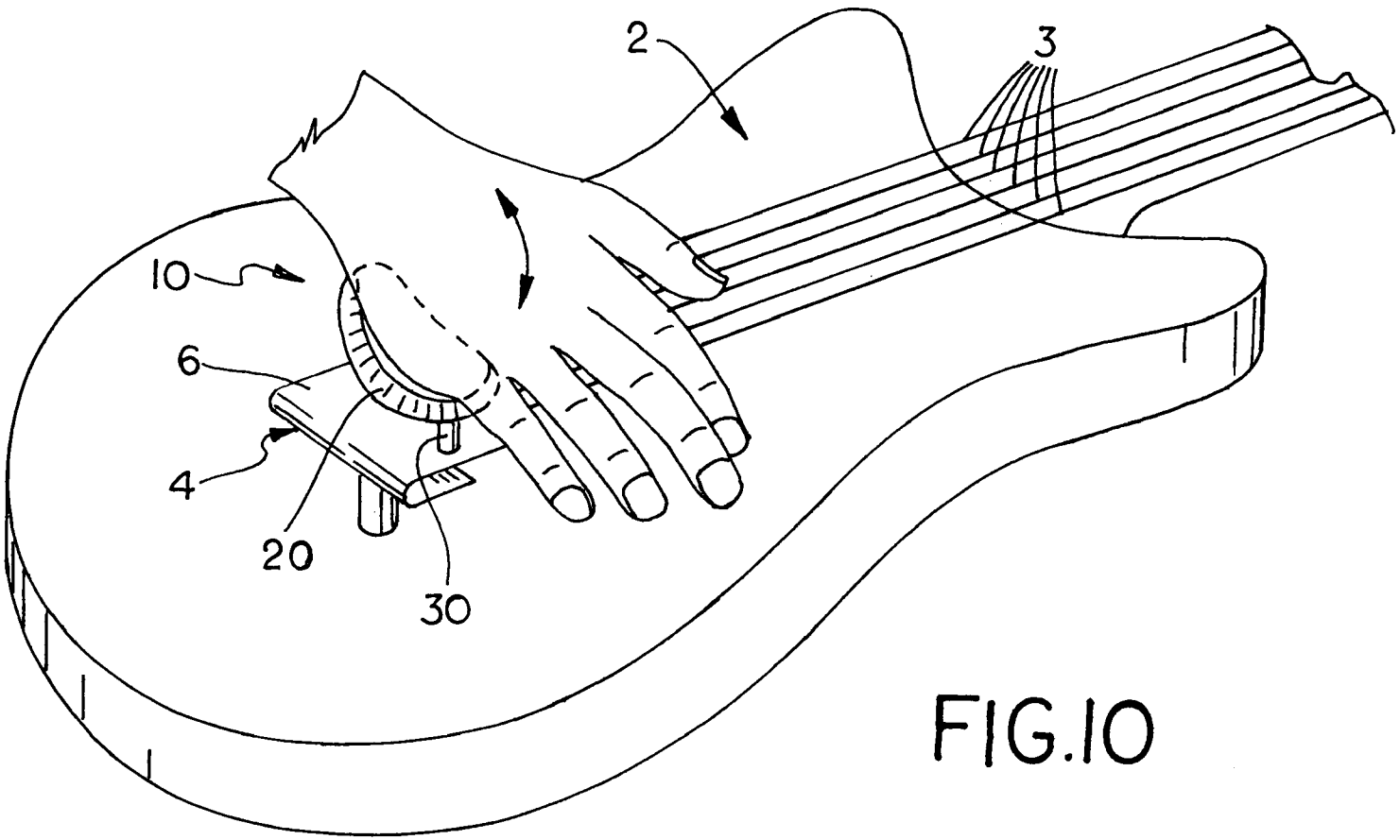
FIG. 10 is a partial perspective view of the tremolo device mounted to a guitar and oriented in a lateral position relative to the instrument strings showing the player's hand resting atop the tremolo device.
Figure 11:
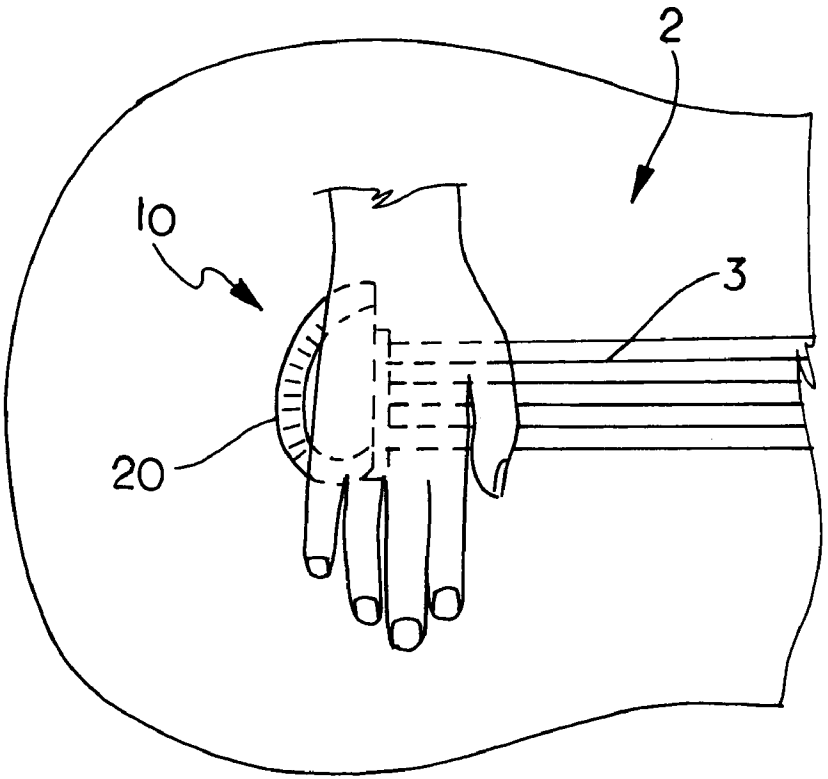
FIG. 11 is a partial top view of the tremolo device mounted to a guitar and oriented in a lateral position relative to the instrument strings showing the player's hand resting atop the tremolo device.
Figure 12:
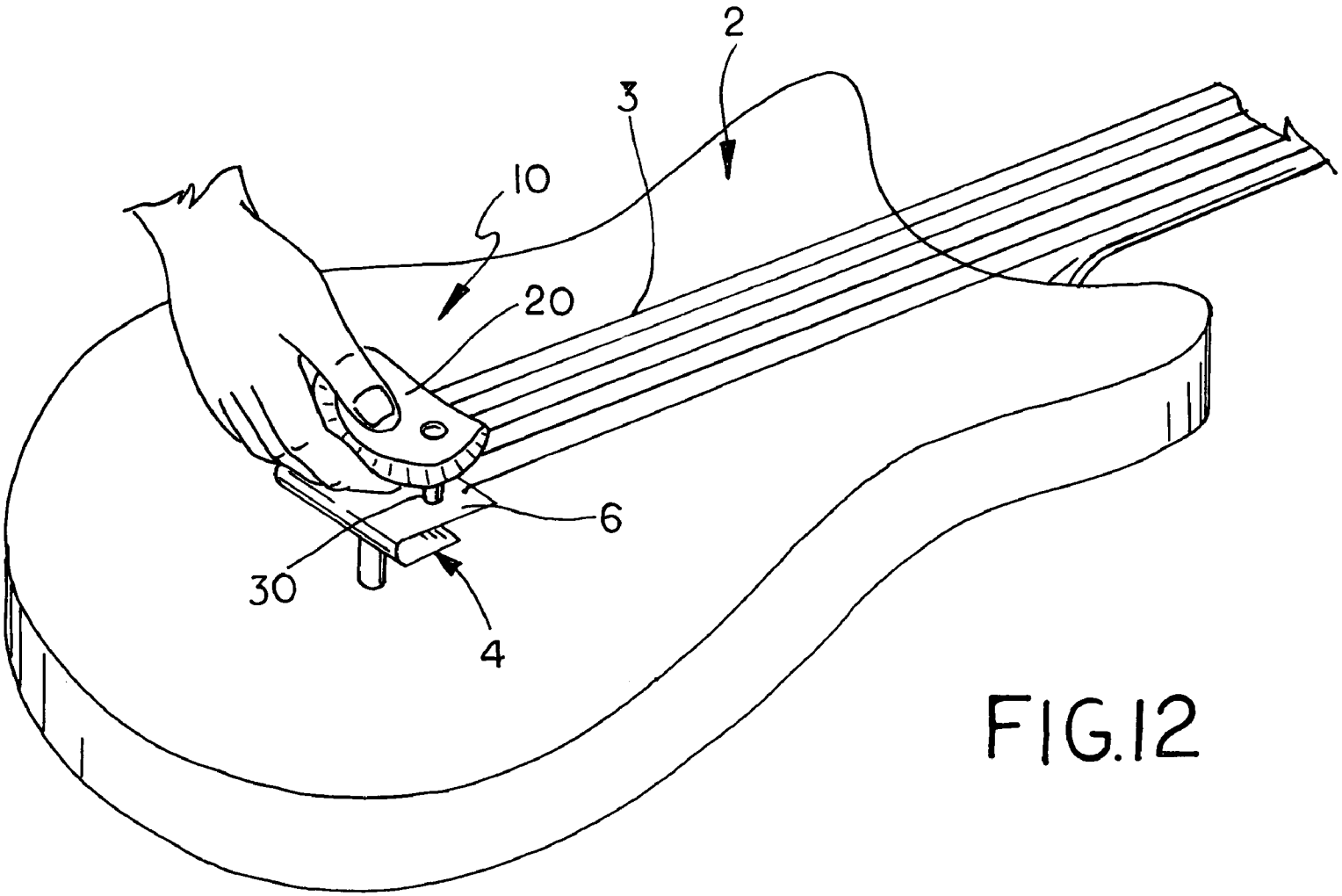
FIG. 12 is a partial perspective view of the tremolo device mounted to a guitar and oriented in a lateral position relative to the instrument strings showing the player's hand pulling on the tremolo device.
Figure 13:
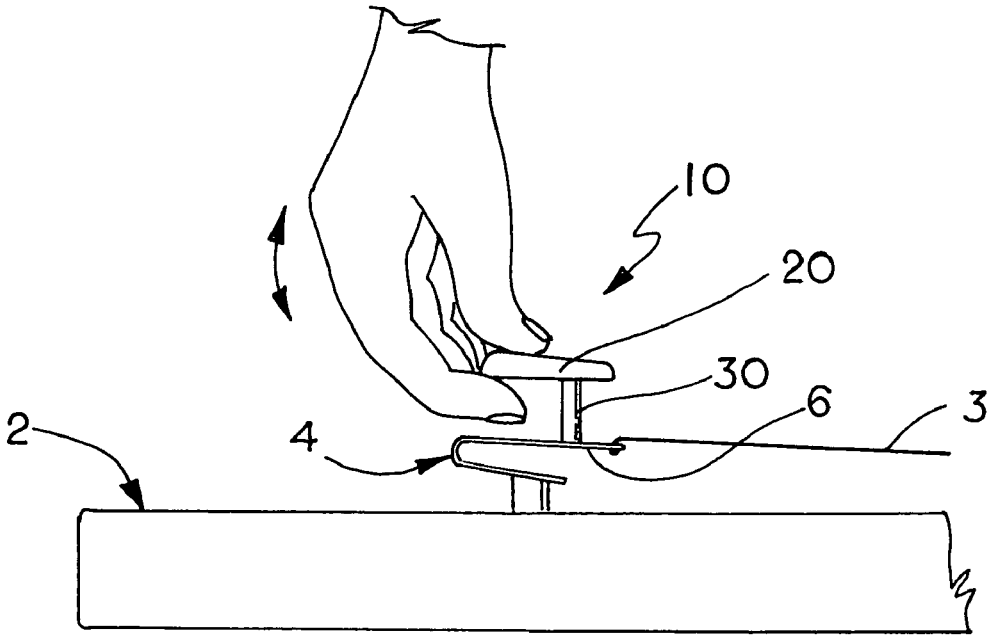
FIG. 13 is a partial side view of the tremolo device mounted to a guitar and oriented in a lateral position relative to the instrument strings showing the player's hand pulling on the tremolo device.
Figure 14:
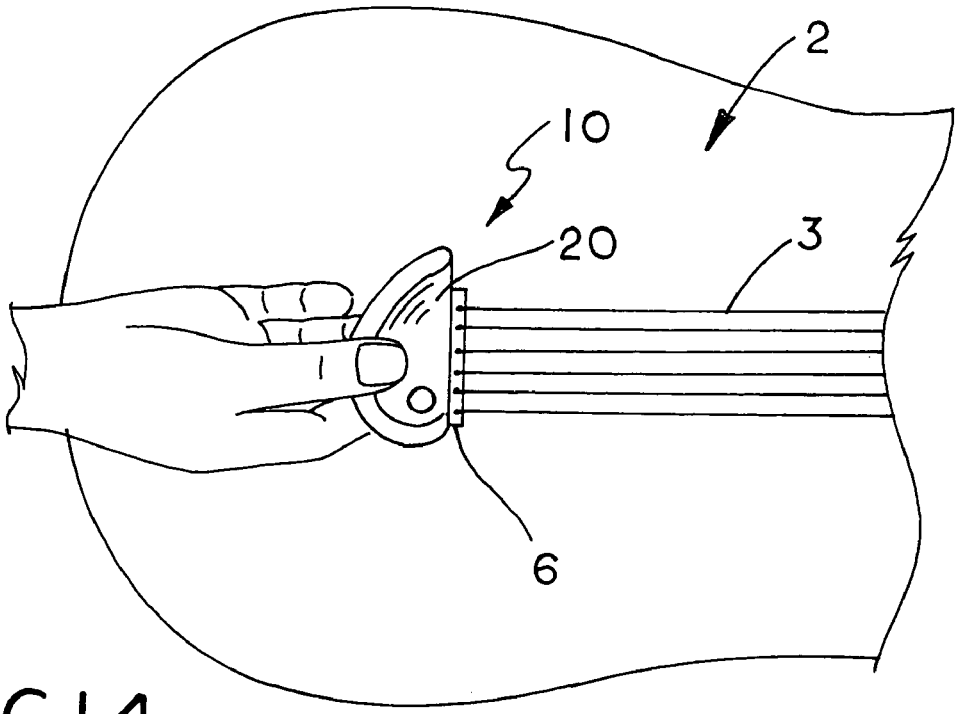
FIG. 14 is a partial top view of the tremolo device mounted to a guitar and oriented in a lateral position relative to the instrument strings showing the player's hand pulling on the tremolo device.
Figure 15:
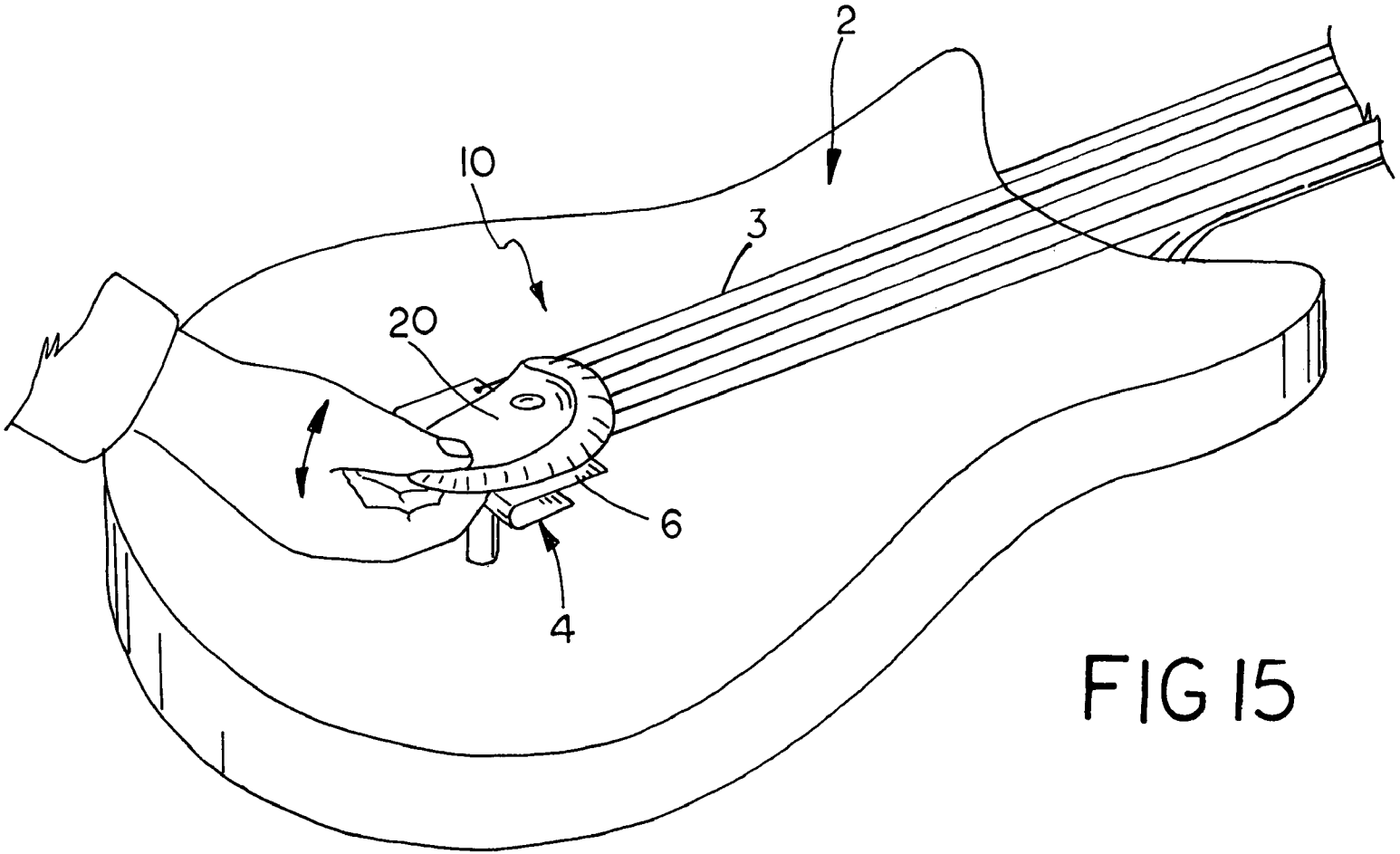
FIG. 15 is a partial perspective view of the tremolo device mounted to a guitar and oriented in a longitudinal position relative to the instrument strings showing the player's hand pulling on the tremolo device.
Figure 16:
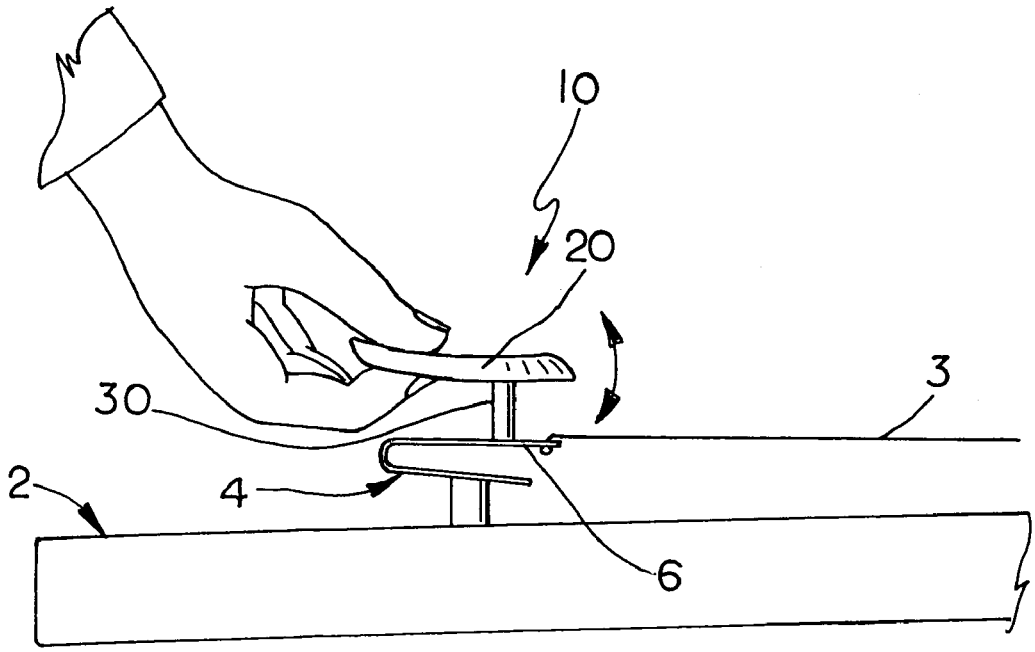
FIG. 16 is a partial side view of the tremolo device mounted to a guitar and oriented in a longitudinal position relative to the instrument strings showing the player's hand pulling on the tremolo device.
Figure 17:
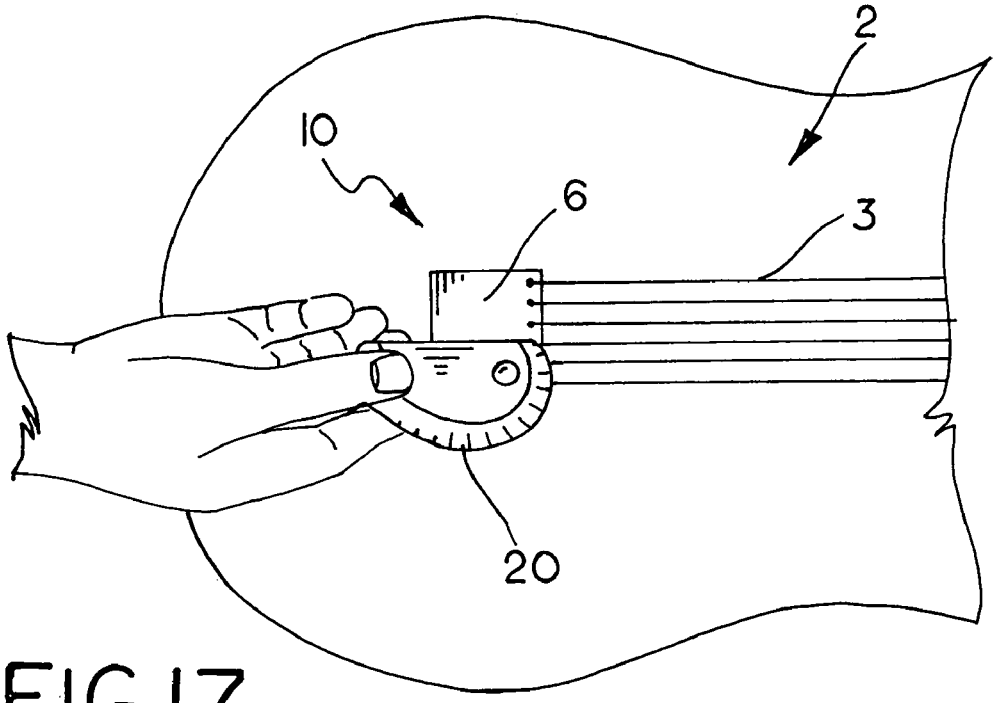
FIG. 17 is a partial top view of the tremolo device mounted to a guitar and oriented in a longitudinal position relative to the instrument strings showing the player's hand pulling on the tremolo device.

FIGS. 10-17 illustrate the use of tremolo device 10 used on guitar 2. Tremolo device 10 allows the musician to push and pull on hand plate 20 to change the tension of the instrument's strings and achieve the desired vibrato, portamento or pitch bend effect. A musician can pull or push on the tremolo device 10 regardless of the orientation of the plate relative to the strings. During a performance, a player can rotate tremolo device 10 to any desired orientation, while still being available to the musician for creating the desired effects. Tremolo device is mounted to the bridge assembly so that the musician's hand rests atop hand plate 20 and is suspended over the bridge in a natural performance posture. FIGS. 10-14 illustrate a musician using tremolo device 10 in a lateral orientation. Tremolo device 10 offers the musician a better playing posture in the lateral orientation. In the lateral orientation, musician's palm, specifically the hypothenar eminence, rests atop hand plate 20 with the finger positioned conveniently over the strings. With the palm resting atop hand plate 20, the musician can press downward on plate 10 to flex tremolo plate 6 and tensions strings 3 (FIGS. 10 and 11). The musician pulls on hand plate 20 to lessen the tension on the strings (FIGS. 12-14). FIGS. 15-17 illustrate a guitar player using the tremolo device 10 in a longitudinal orientation. Tremolo device 10 offers the musician more leverage in the longitudinal orientation due to the length and attitude of hand plate 20 relative to bridge assembly 4 and strings 3. Again, the musician applies downward pressure on hand plate 20 with the palm to tension strings 3 (not shown) and pulls on the bottom of hand plate 20 to lessen the tension on the strings (FIGS. 15-17).

One skilled in the art will note that the tremolo device of this invention provides several advantages over conventional tremolo bars. The tremolo device of this invention eliminates the problem of tremolo bars hanging out of the reach of the musician's pick hand. Unlike conventional tremolo bars that hang down from the bridge where the musician has to reach down and swing the arm upward into position before apply the pressure to pull or push on the bar to create the desire effect, the tremolo device is readily accessible from the pick hand's natural playing posture. While always readily available to the musician, the hand plate is suspended over the bridge assembly to the rear of the strings, where it will not interfere with the normal playing of the instrument. The tremolo device of this invention is also more rigid than conventional tremolo bars, which affords the musician greater control over the sound of the instrument. Because the mounting post is relatively short and securely welded to the hand plate, the musician can transfer more force through this tremolo device to the tremolo bridge.

The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

I claim:

1. A tremolo device for stringed instruments having an instrument body, a plurality of strings extending thereover, and a bridge assembly connecting the plurality of strings to the instrument body and capable of limited pivotal movement relative to the instrument body, the tremolo device comprising:

a substantially planar hand plate: and a post extending perpendicularly from the hand plate, the post adapted for mounting to the bridge assembly so that the hand plate is spaced over the bridge assembly and strings and so that the post rotates axially relative to the bridge assembly, the hand plate has a top surface and a bottom surface, the hand plate also having an elongated eminence rising from the top surface and a corresponding elongated depression descending from the bottom surface.

2. The tremolo device of claim 1 wherein the hand plate has an ovate shape.

* * * * *